United States Patent [19]

Hosono et al.

[11] 4,356,245

[45] Oct. 26, 1982

[54] METHOD AND APPARATUS FOR ELECTROPHOTOGRAPHIC, IMAGE DEVELOPMENT WITH MAGNETIC TONER

[75] Inventors: Nagao Hosono, Shizuoka; Koichi Kinoshita, Narashino; Toru Takahashi, Tokyo, all of Japan

[73] Assignee: Canon Kabushiki Kaisha, Tokyo, Japan

[21] Appl. No.: 141,919

[22] Filed: Apr. 21, 1980

Related U.S. Application Data

[63] Continuation of Ser. No. 938,101, Aug. 30, 1978, abandoned.

[30] Foreign Application Priority Data

Sep. 10, 1977 [JP] Japan ..... 52-109237
Sep. 10, 1977 [JP] Japan ..... 52-109238
Sep. 10, 1977 [JP] Japan ..... 52-109239

[51] Int. Cl.[3] ..... G03G 13/09
[52] U.S. Cl. ..... 430/122; 430/106.6
[58] Field of Search ..... 430/122

[56] References Cited

U.S. PATENT DOCUMENTS 3,232,190 2/1966 Willmott ..... 355/3 DD
3,754,963 8/1973 Chang ..... 427/14
3,890,929 6/1975 Walkup ..... 118/653
3,914,460 10/1975 Maksymiak ..... 427/14
3,997,688 12/1976 Gundlach et al. ..... 427/14
4,011,834 3/1977 Stephan ..... 118/653
4,014,291 3/1977 Davis ..... 118/658
4,036,175 7/1977 Phillips et al. ..... 118/653
4,067,295 1/1978 Parker et al. ..... 118/653
4,100,884 7/1978 Mochizuki et al. ..... 118/653

*Primary Examiner*—John D. Welsh
*Attorney, Agent, or Firm*—Fitzpatrick, Cella, Harper & Scinto

[57] ABSTRACT

A method and apparatus for developing an electrostatic image on an electrostatic image holding member by feeding toner particles thereto, in which a layer of the toner particles is formed on a toner carrying member, and the toner carrying member and the electrostatic image holding member are brought to a mutually closer position and maintained in such a range that the surface of a non-image section of the electrostatic image holding member and the surface of the toner particle layer on the toner carrying member may not be contacted with each other, but the surface of the toner particle layer is in contact with the surface of the image region of the electrostatic image holding member, whereby uniform development of the electrostatic image on the image holding member can be effected.

20 Claims, 12 Drawing Figures

METHOD AND APPARATUS FOR ELECTROPHOTOGRAPHIC, IMAGE DEVELOPMENT WITH MAGNETIC TONER

This is a continuation, of application Ser. No. 938,101, filed Aug. 30, 1978, now abandoned.

BACKGROUND OF THE INVENTION

1. Field of the Invention

This invention relates to novel method and apparatus for image development, and, more particularly, it is concerned with the method and apparatus for image development capable of producing good visible image free from fog on its non-images surface.

2. Description of the Prior Art

For the method of developing an electrostatic latent image formed by various kinds of electrostatic latent image forming methods, there have so far been known two major methods: the one is the dry type developing method, and the other is the wet type developing method.

In the former method, the image development can be achieved by the use of not only a binary component type developer which consists of toner particles dispersed in a carrier, but also a single component type developer consisting of toner particles alone. There are various methods using the binary component type developer such as, for example, magnet brush method which utilizes iron powder as the carrier, cascade method which utilizes beads as the carrier, the fur brush method which utilizes fur, and so forth. There are also various methods using the single component type developer such as, for example, the powder clouding method which utilizes toner particles in an atomized state, the contact development method (also called "doner development") which causes the toner particles to directly contact to the surface of an eletrostatic latent image for development, magne-dry method which causes electrically conductive magnetic toner to contact the surface of an electrostatic latent image for development, jumping method which causes the toner particles to be electrically charged and jump toward the latent image surface by the electric field the electrostatic latent image possesses, and other methods.

The development method using the binary component type developer primarily possesses such disadvantages that, since it uses a developer consisting of a mixture of the carrier particles and the toner particles and since a much larger quantity of the toner particles than the carrier particles is consumed, the mixing ratio between the toner and the carrier considerably changes with the consequent non-uniformity in density of the developed image, and the image quality lowers due to deterioration of the carrier particles which are difficult to be consumed for its long hours of use, and various other disadvantages.

On the other hand, the development method using the single component type developer has no apprehension at all of such non-uniformity in image density due to change in the mixing ratio between the carrier and the toner, and the influence on the image quality due to deterioration in the carrier, and so forth, as is the case with the binary component type developer.

The above-described classification is based on the types of the developer. And, there is another way of clasification based on the mode of development, as follows.

The first system or mode may be called "indiscriminate contact development", in which the developer is contacted indiscriminately onto both image portion on the surface of an electrostatic latent image holding member (a region where the electrostatic charge exits to attract the toner particles) and a non-image portion thereof (a region where no electrostatic charge exists in general, and no toner particles are attracted thereto), leaving the toner particles on the image portion alone. The method to be used for this mode of development includes the cascade method, magnet brush method, fur brush method, powder clouding method, magne-dry method, the doner contact method, and so on.

The second system or mode may be called "jumping development", in which a layer of the toner particles is positioned to face the surface of the electrostatic latent image holding member with a small gap therebetween so that the toner particles may jump to the surface of the image holding member from the toner particle layer. This system is described in, for example, U.S. Pat. Nos. 2,839,400 or 3,232,190.

Even in the first-mentioned indiscriminate contact development system, the so-called fogging phenomenon, wherein the toner particles remain adhered onto the non-image portion of the surface of the electrostatic latent image holding member, is unavoidable. On the other hand, the second-mentioned jumping development system is known to be able to avoid ocurrence of the fogging phenomenon to a substantial degree. In spite of this fact, this jumping development system has not so far been used practically in contrast to the former system having been practically utilized in various reproduction apparatuses and recording apparatuses. The reason for such non-practical use of the jumping development system is due to the following problems inherent in this system.

(1) Uniform application of the toner is difficult.

Although the electric field is imparted beforehand to a toner carrying sheet member to cause the toner to be adhered thereto, uniform adhesion of the toner particles is difficult to attain. Taking a well known rigid blade as an example of the method for uniformly applying the toner, it is difficult to uniformly and thinly apply the toner particles, unlike liquid medium, hence irregularity in the toner application tends to appear readily. Since this irregularity in the toner application is directly reproduced by development, this rigid blade method is not suited for the practical image reproduction. As the measures for improving this rigid blade method, there may be contemplated a method in which the surface of the toner carrying sheet member is made of cloth, paper, and the like so that the toner particles may be filled in the voids of such cloth and paper materials, although it is difficult to expect that much finer toner particles than coarseness of the textile and fibers constituting the cloth and paper materials be produced, and the uniform toner application be effected. On the other hand, in the method where the toner is previously adhered to a sheet-formed toner carrying member by the cascade development method, the apparatus as a whole inevitably increases in size, which is also not practical.

(2) Uniform toner separation from the toner carrying member is difficult.

When the toner layer as applied to the toner carrying member faces the electrostatic latent image, it becomes necessary to uniformly separate the toner and transfer the same to the image surface. Unless this transfer takes place uniformly, no uniform development can be effected. Such uniform toner separation depends on the surface property of the sheet to carry the toner thereon, and is also affected by a state when the toner is applied to the toner carrying member as well as by the characteristic property of the toner per se. There has so far been no toner carrying member which has attained the practical level.

(3) Image resolution is low.

In the well known jumping development method, there is adopted a method of electrostatically adhering the toner on the toner carrying member, so that, even if a relatively thin toner layer is formed on the toner carrying member, the toner particles are assumed to separate from the surface of the toner carrying member and fly toward the surface of the electrostatic latent image due to mutually repulsive electric charge the toner particles possess, when a clearance between the toner layer and the electrostatic latent image surface becomes 3 mm or so. With such a wide space gap, however, the time for the toner particles to separate from the surface of the toner carrying member and fly toward the surface of the electrostatic latent image becomes long. Moreover, the toner is apt to be affected by air current flowing through the gap, the gravity of the toner itself, or vibrations of the electrostatic latent image surface and the toner carrying member during their flight. As a consequence, the developed image tends to be easily disturbed. Further, the electric field of the electrostatic latent image of thin lines and letters does not reach the surface of the toner carrying member with fidelity, which results in thinning of such thin lines and letters, or the toner particles do not fly to considerably lower the image resolution.

SUMMARY OF THE INVENTION

In view of the above-described various problems inherent in the conventional method and apparatus, it is the primary object of the present invention to provide a novel method and an apparatus free from such disadvantages.

It is the secondary object of the present invention to provide a method and an apparatus for image development capable of producing a favorable, fog-free developed image.

It is the third object of the present invention to provide a method and an apparatus for image development capable of producing developed image free from fog and having high sharpness in the formed image.

It is the fourth object of the present invention to provide a developing device which is small in size and capable of securing adequate image development.

According to the present invention, in one aspect thereof, there is provided an image developing method, wherein, at the time of developing an image by feeding toner particles to an electrostatic latent image held on an electrostatic image holding member, a layer of the toner particles is formed on a toner carrying member, then the toner carrying member having thereon the toner particle layer and the electrostatic image holding member having on its surface the electostatic image are mutually brought closer, and both members are maintained within a range where the surface of a non-image portion of the electrostatic image holding member is not contacted with the surface of the toner particle layer on the toner carrying member, and the surface of the toner particle layer is in contact with the surface of the image portion in the electrostatic image holding member, thereby developing the electrostatic image on the electrostatic image holding member.

According to the present invention, in another aspect thereof, there is provided an image developing method, in which a space gap between the surface of the toner particle layer on the toner carrying member and the surface of the electrostatic image holding member is made 10 times or below as large as the thickness of the toner particle layer.

According to the present invention, in still another aspect thereof, there is provided an image developing method, in which the space gap between the surface of the toner particle layer on the toner carrying member and the surface of the electrostatic image holding member is made 1/5 or above as thick as the thickness of the toner particle layer for particularly favorable development.

It should be noted that the space gap between the surface of the toner particle layer and the surface of the electrostatic image holding member as the well as thickness of the toner particle layer are determined on the basis of a condition, in which the electrostatic image on the surface of the electrostatic image holding member is in no way affected thereby, as a reference.

BRIEF DESCRIPTION OF DRAWING

In the accompanying drawing:

FIG. 2 shows a state of the same in its image region;

DESCRIPTION OF THE PREFERRED EMBODIMENTS

Figure 1:
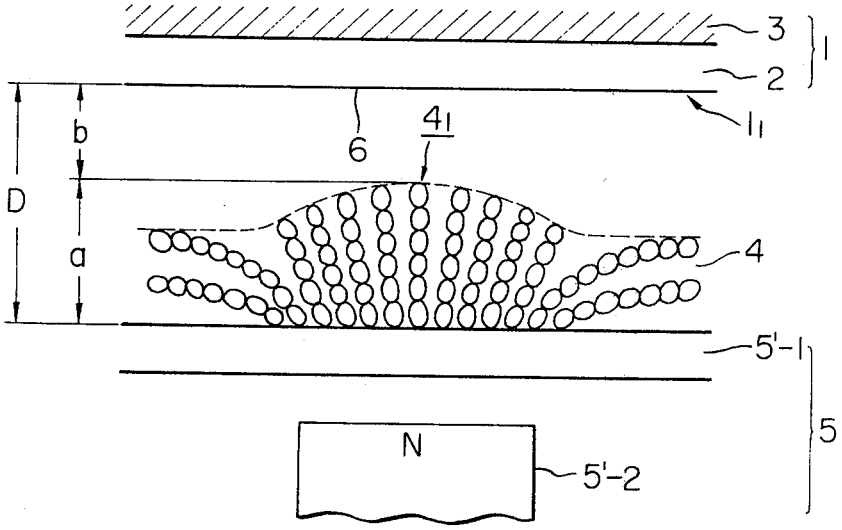
FIGS. 1 and 2 are schematic diagrams explaining the principle of the present invention, in which the FIG. 1 shows a state of the electrostatic image holding member in its non-image region.
Figure 2:
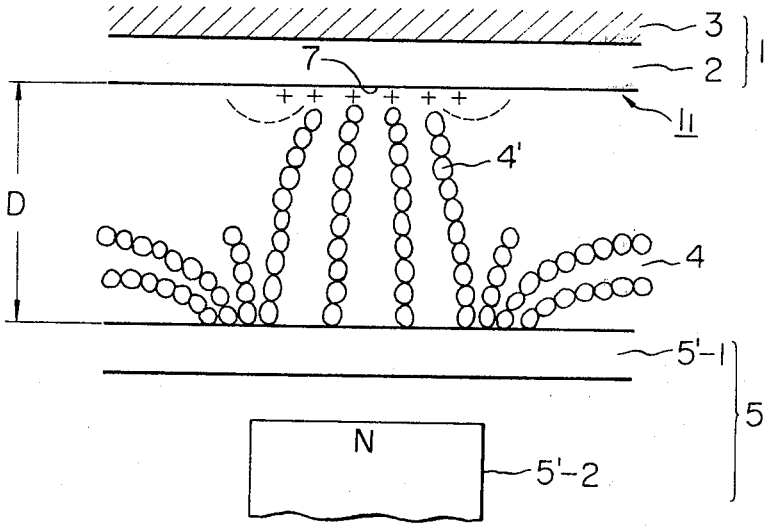

Referring to FIGS. 1 and 2, a reference numeral 1 designates an electrostatic latent image holding member which is constructed with an insulative holding plate 2 and an electrode 3 overlaid on the back surface of the holding plate 2, the front surface $1_1$ thereof being made to hold thereon an electrostatic image. For the electrostatic image holding member, there may be used an insulating member, or a photosensitive member having a photoconductive layer thereon, and others.

A reference numeral 4 designates a layer of toner particles carried on a toner carrying member 5. This toner particle layer is closely positioned to the above-mentioned electrostatic image holding member 1. The toner particle layer on this toner carrying member 5 is the so-called single component type developer which contains therein no component such as a carrier, etc. As will be described later, the toner to be used may be either electrically conductive or insulative. From the standpoint of development control characteristic or conveyability, a magnetic toner is particularly preferable for the method of the present invention. Accordingly, in the following explanations of the actual embodiments, the magnetic toner will be taken as an example.

In order that the toner particle layer may be held on the toner carrying member 5, there may be used action of gravity, electrostatic force, magnetic force, and so forth. In the illustrated embodiment, the toner particle carrying member 5 is composed of a non-magnetic metal plate 5'-1 and a magnetic pole (N) 5'-2 disposed at the back surface of the metal plate 5'-1.

The toner particles are oriented in the direction of the magnetic field by the action thereof, as diagrammatically illustrated in the drawing. The trains of the toner particles thus oriented by the magnetic field are eminently erected in the vicinity of the magnetic pole as if ears of a cereal plant stand upright. In FIG. 1, there is shown a state, in which no electrostatic image is present on the electrostatic image holding member 1, and a non-image surface 6 faces a surface $4_1$ of the toner layer 4 at the tip end of the erected ears of the toner particles. On the other hand, the surface $4_1$ of the toner layer constituting the tip end of the toner particle ears and the surface of the non-image portion in the electrostatic image holding member 1 are mutually disposed in a noncontact relationship with a space gap b being provided therebetween. By thus maintaining the non-image surface 6 and the toner layer surface $4_1$ in a non-contact relationship, possible occurrence of fog at the non-image portion 6 can be avoided.

FIG. 2 explains a state, wherein an image portion 7 is being developed on the electrostatic image holding member. According to this illustration, the toner layer facing the image surface increases its thickness in the direction of the electric field by the action of the electric field due to the electrostatic image on the image surface, rises upward to the image surface or grows to erect as if ears of a cereal plant extended upward (this phenomenon will hereinafter be referred to as "toner growing phenomenon"). The space gap b is provided beforehand between the surface $1_1$ of the electrostatic image holding member 1 and the surface of the toner particle carrying member 5 so that the tip end of the toner particle ears may contact the image surface on the electrostatic image holding member.

As described above, since the toner layer brings about the "toner growing" phenomenon at the image portion, and the tip end of the toner ears as grown is caused to directly contact the surface of the image portion, there is no apprehension at all as to instability in the movement of the toner particles such that the toner particles get off their course during flight due to air current, etc., and that the landing points of the toner particles discord due to vibrations, etc., as is the case with conventional jumping development where the development is effected by jumping of the toner particles. As the consequence, the possibility of deterioration in the image quality due to instability in the toner particle movement can be perfectly avoided. Moreover, since the toner particle layer does not contact the non-image portion as described above, no fogging phenomenon takes place at the non-image portion, which makes it possible to produce an extremely clear image in comparison with the image to be obtained by the conventional indiscriminate contact development method.

In the above-described drawing figures explaining the principle of the present invention, magnetic force is used for retaining the toner particles on the toner particle carrying member, as one example, although various other means may be utilized as mentioned in the foregoing, or to be described later in the actual examples of the present invention. In either case, there takes place the toner growing, although the degree of such toner growing may vary depending on the property of the toner particles and the other conditions. In particular, the electrostatic supporting of the toner particles is very effective from the standpoint of the characteristic of the toner to be electrostatically controlled.

For the effective utilization of the "toner growing" in the case of ordinary toner particles, it is necessary that the space gap b between the surface $1_1$ of the electrostatic image holding member 1 and the surface $4_1$ of the toner particle layer 4 be at a rate 10 times or less than thickness of the toner layer a.

In particular, when the toner particles are held by the abovementioned magnetic force, the action of the magnetic field assists the "toner growing" due to the electric field of the electrostatic image, and the "toner growing" can be achieved very satisfactorily.

Figure 3:
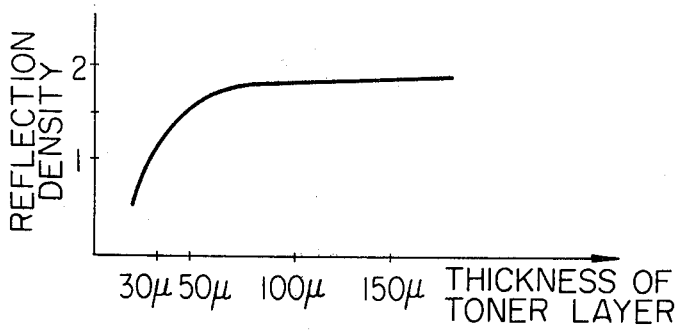
FIG. 3 is a graphical representation showing a relationship between image density and toner thickness.

The graphical representation in FIG. 3 shows a relationship between the image density and thickness of the toner layer. This density v. layer thickness relationship is applicable to the toner layer having a thickness range of 4 to 10 microns for ordinary use. As seen from this graph, the density of the developed image is shown to be remarkably affected by variations in the toner thickness of upto 30 microns or in its vicinity, while it tends to be saturated with the toner thickness of 30 microns and above.

Accordingly, it is indispensable to control the toner layer to maintain uniform distribution of the image density when the toner thickness is below 30 microns, in which the image density is unstable. With the toner layer of above 30 microns in thickness, however, satisfactory image density can be obtained easily. With the toner layer of 100 microns and above in thickness, the image density is no longer problematical because it has already attained a substantially saturated condition. Accordingly, in order to adjust the space gap between the surface of the electrostatic image holding member and the surface of the toner particle layer, the thickness of the toner layer in the abovementioned range may be arbitrarily used. On the other hand, since such increased thickness in the toner layer inevitably invites increase in the toner replenishing quantity, it is preferable to use the toner layer of 100 microns or below from the standpoint of economy and easiness in operation.

It has been found out at the time of the abovementioned reproduction that, in the course of developing thin lines or images having narrow non-image regions surrounded by the thin lines such as very fine letters, symbols, or designs having very delicate patterns, these fine image portions are buried with the toner to be marred or disfigured. This phenomenon has been solved by the following method.

Figure 4:
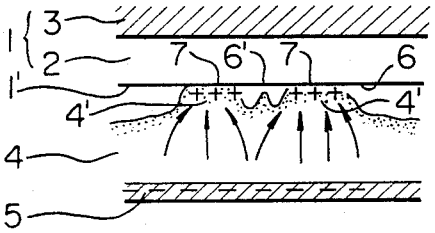
FIG. 4 is a diagrammatic view explaining a state of image development, wherein a narrow non-image region exists in the image.

The diagram shown in FIG. 4 explains a state wherein an image 7 having a narrow non-image region 6' on the electrostatic image holding member 1 is being developed. It is observed that, at a non-image portion 6 having a wide area on the surface $1_1$ of the electrostatic image holding member 1, the toner layer 4 and the surface $1_1$ of the electrostatic image holding member 1 are maintained in a non-contact state. However, at the image portion, the thickness of the toner layer abruptly increases due to the abovementioned "toner growing" phenomenon, and that, when the gap between the augmented toner surface 4' and the surface of the electrostatic image holding member is small, the toner layer reaches the surface of the image holding member 1 and directly contacts thereto, while, when the gap is large, the toner particles fly toward the surface of the electrostatic image. Further, when detailed observations are made on the state of the fine image portions, the thickness of the toner layer is also seen to increase toward the narrow non-image region 6' between the mutually neared image portions 7, 7. It is also recognized that, when the gap between the toner carrying member and the electrostatic image holding member is small, the contact of the toner to this non-image region on the surface of the electrostatic image holding member takes place, and, even when the gap is large, the flight of the toner takes place.

It has been found out that this phenomenon is based on the fact that, since the electric field due to the electrostatic image 7 assumes a sector shape toward the electrically conductive part of the toner carrying member 5, the toner particles in the narrow non-image portion 6'-existing between the electrostatic images, which have been attracted by increase in thickness at this part of the toner layer, inevitably grow in spite of the electric field being weak. While the extent of this growth is not sufficiently clear due to the phenomenon to take place being very small, it has been found to be related with the rate of increase in the toner layer, the relationship of which is approximately $\frac{1}{3}$ of a thickness of the toner layer at the non-image forming portion, or ordinarily below 1/5 or below thereof. Therefore, when the gap b between the surface $4_1$ of the toner layer 4 and the surface $1_1$ of the electrostatic image holding member 1 is maintained above 1/5 of the toner layer thickness, while the thickness of the toner layer varies from 30 to 100 microns, the disfiguring of the fine portion could be remarkably improved by maintaining the abovementioned relationship with respect to variations in thickness of the toner layer.

By the present method, it is further possible to obtain the image reproduction with higher image sharpness by appropriate setting of the developing conditions. That is to say, such image sharpness can be achieved as the result of clarification of the non-developing phenomenon at the peripheral part of the image, which is the cause for image indistinctness at the peripheral part thereof, in the case of the known jumping development. In other words, use is made of an interrelationship between a width d of the undeveloped region and a distance D between the surface of the toner layer and the surface of the image development, which is the cause for such non-developing phenomenon as will be detailed hereinbelow.

Figure 5:
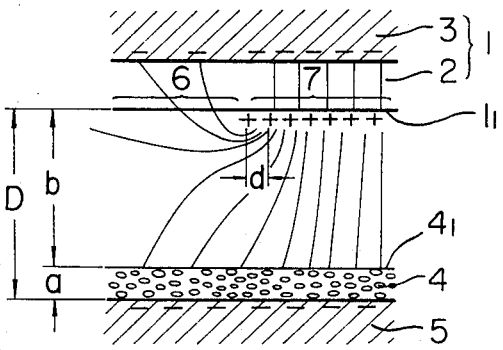
FIG. 5 is a diagrammatic view explaining a state of electric field at the end part of the electrostatic image on the electrostatic image holding member.

The diagram in FIG. 5 explains the condition of the electric field at the edge portion of the electrostatic image on the electrostatic image holding member. It has been found out that the shape of this electric field is closely related with the non-development at the edge portions of the image. That is, the electric field at the edge portion of the image is directed, in one part thereof, to the electrode 3 on the back surface of the electrostatic image holding member opposite to its front surface $1_1$, on account of which the electric field functioning to attract the toner, i.e., the electric field directing to the electrically conductive part of the toner carrying member 5, emanates from the place slightly inside of the edge portion of the image. This small distance is denoted by d in the drawing. It has been found out that, owing to this distance d, the region where the toner is attracted and adhered to the surface of the electrostatic image holding member is inside from the edge portion by the distance b, which constitutes the reason for the non-developing phenomenon at the edge portion of the image. The theoretical value of the distance d is related with the distance D between the surface of the electrostatic image holding member and the surface of the electrically conductive part (developing electrode) of the toner carrying member, which is in an approximate relationship of $d \approx 1/5$ D (provided that the non-image portion is at a zero potential, and both image and non-image portions infinitely expand in every direction along a straight line normal to the surface of the electrostatic image holding member). Actually, however, the relationship is found to be $d \approx 1/10$ D seemingly due to the flying characteristic of the toner, and other factors being related therewith.

On the other hand, if the smallest portion of the electrostatic image such as letters, patterns, symbols, etc. formed on the surface of the electrostatic image holding member (for example, a portion such as a thin line) has an image width c, and this width is reproduced with sufficiently thin, there can be obtained very clear and sharp image. Of course, not only the smallest portion of the image, but also the periphery of the image as a whole can be made very precise, so that the abovementioned effect can be exhibited. As the condition to attain this purpose, the following relationship can be found: $c-2d>0$. Accordingly, since the boundary condition of whether the image having the image width c can be reproduced, or not, is represented substantially as $c=2d$, the gap D at this time can be obtained as $D \approx 10$ d ($=5c$). In other words, the above inequality can also be represented as $c>1/5$ D ($\approx 2d$), from which it is understood that the gap D should be made 5c or below in order to reproduce the image width c. When the gap D is made large, the image width c to be reproducible becomes large accordingly.

An additional example is that the image resolution necessary for printing, etc. is ordinarily 5 lines/mm or so, at least, and the thickness of the the thin line image to be reproduced is 100 microns or so. In order therefore to maintain such resolution, it is understood that a relationship of $D<500$ microns ($d<50$ microns) be established. Adjustment of the image width is determined at an appropriate position in the gap of 500 microns and below, i.e., at a position represented by $D_1=5(C_0-C_1)$, because, in this case, a difference between the image width $C_1$ to be reproduced and the image width $C_0$ of the electrostatic image, $(C_0-C_1)12$, is taken as the width at the peripheral undeveloped portion. Incidentally, it is to be noted that the illustration in FIG. 5 is drawn in such a manner that the surface of the toner layer 4 is substantially flat, and the layer thickness a is taken with this flat surface as the reference, while the surface of the toner layer and the surface of the electrostatic image holding member are provided with the gap D therebetween. The illustration is different from a state where an electrostatic image is present. This is for facilitating understanding of the layer thickness, the space gap, and so on.

Figure 6:
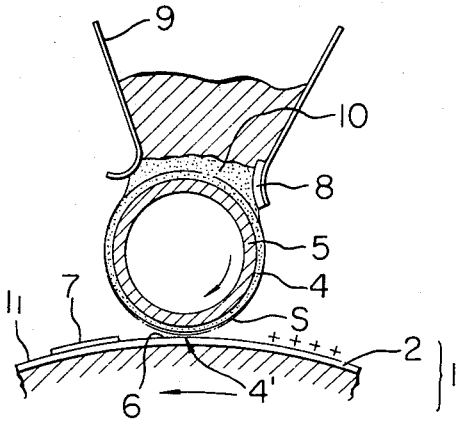
FIG. 6 is a partially enlarged view in cross-section for explaining an actual developing device to practice the method of the present invention.

FIG. 6 explains one actual developing device to practice the method the present invention. In the drawing, the electrostatic image holding member 1 may usually be made of an insulating member sufficient to hold thereon an electrostatic image such as, for example, Mylar (a trademark for a polyester film manufactured and sold by E. I. du Pont de Nemour & Co., U.S.A.), and so on. It may also be made of inorganic photoconductive materials such as ZnO, CdS, CdSe, Se, etc., organic photoconductive materials such as polyvinyl carbazol, etc. or these inorganic and organic photoconductive members provided with a transparent insulating layer thereon so as to enable the electrostatic image to be directly formed on the surface of the holding member.

The electrostatic image holding member 1, for the purpose of forming an electrostatic latent image thereon, is provided with the abovementioned photoconductive layer or the photoconductive layer 2 having on its surface the transparent insulating layer, and the electrode 3 closely adhered on the back surface of the photoconductive layer so that the electrostatic image may be retained on the opposite surface $1_1$ thereof. It is of course possible that, depending on the material selected for the abovementioned electrostatic image holding member 1, the electrostatic image may be formed on the image holding member by the known electrophotographic method, or such image may be formed at another place and then transferred onto this image holding member. A reference numeral 4 designates the toner layer for the purpose of the development, which is held on the toner carrying member 5.

The toner carrying member 5 should be constructed to hold the toner on it so as to attain the purpose of the present invention. It can hold the toner particles on its surface by imparting electrostatic force, magnetic force, adhesive force, etc. More concretely, the toner is given the magnetic property, for example, and the layer 4 of such magnetic toner is moved along with rotation of a sleeve made of non-magnetic metal material with a magnetic roller being provided inside thereof.

The non-magnetic metal sleeve may be made of, for example, aluminum, and the surface magnetic flux density of the magnetic roller may range from 600 to 1,300 gausses. The surface of the metal roller to be used as the toner carrying member may be directly contacted to the toner, or indirectly thereto through an insulating layer, semi-conductor layer, etc. It is important, however, that the toner carrying member should have at least an electrically conductive member as in the metal roller, because this electrically conductive member is caused to act as the developing electrode to insure satisfactory image formation. The toner carrying member 5 holding the toner layer 4 on its surface and the electrostatic image holding member 1 are opposed to each other at the developing position so as to maintain a predetermined space gap D between the surface of the electrically conductive electrode of the toner carrying member and the surface of the electrostatic image holding member 1.

In case of the abovementioned example of using a metal sleeve, the gap between the sleeve surface and the electrostatic image holding member surface apparently corresponds to the abovementioned gap D. The mechanism for supporting the sleeve surface and the image holding member surface in a mutually opposed relationship may be any one of the well known expedients. It is of course possible that, depending on the requirement for the reproduced image by the device, the supporting mechanism may be fixed or movable. In order to fixedly maintain the gap therebetween, there may be used, for example, a roller which is engaged with the toner carrying member in such a manner it may contact the electrostatic image holding member surface or its back surface electrode and an urging spring which absorbs vibrations to take place at the time of rotation of the roller to constantly maintain the contact between the roller and the image holding member. The construction shown in FIG. 6 is such that a roller spacer S (indicated by a chain line) coaxially rotating with the sleeve roller as the toner carrying member and contacting the end part of the electrostatic image holding member surface is provided.

For the gap to be variable, the toner carrying member is held on a movable table, and this movable table is adjusted for the desired gap.

As stated above, when each of the rotating toner carrying member 5 and the electrostatic image holding member 1 arrive at the developing position maintaining the gap between them, as the surface $1_1$ of the electrostatic image holding member and the surface $4_1$ of the toner layer are in a non-contacted state, the non-image portion 6 is not developed as a matter of course, while the toner particles grow at the image portion 7 as mentioned above to effect the development. A toner layer thickness adjusting device 8 using a resilient blade to feed the toner layer onto the toner carrying member with a predetermined thickness is provided beneath a toner feeding hopper 9 which is filled with an appropriate quantity of replenishing toner 10.

For the toner layer thickness adjusting device to uniformly maintain the toner layer, there may be used, besides the abovementioned resilient rubber blade, a rigid blade which maintains a definite gap width with the toner carrying surface, or a rigid roller, or a knurled roller, any of the thickness adjusting device is able to establish various conditions in accordance with its characteristic property for effective functions. In the following, further details are given as to the case of using the abovementioned resilient rubber blade as a concrete example of the present invention.

For obtaining a predetermined thickness of the toner layer, a rubber material having hardness of 70 and below is used. The resilient blade made of this rubber material is press-contacted to the sleeve surface as the toner carrying member 5 with respect to its longitudinal direction at a pressure of 0.4 to 40 g/cm$^2$, whereby the toner layer thickness substantially meeting the practical purpose can be maintained. By the use of urethane rubber or silicone rubber, for instance, and press-contacting the blade of this rubber material to the sleeve surface at a pressure of 8 g/cm$^2$ or so, a uniform thickness of the toner layer of 50 microns or so can be formed. Also, not only regulation of the toner layer thickness, but also selection of a material capable of applying a desired charge polarity to the toner at the same time is extremely effective. For example, when ethylene-propylene rubber, fluorine rubber, natural rubber, polychlorobutadiene, polyisoprene, and N.B.R. are selected for positively charging the toner composed of polystyrene, magnetite and carbon, etc., and silicone rubber, polyurethane rubber, styrene-butadiene rubber, etc. are selected to negatively charging the toner, the frictional charging effect of the toner improves, although the effect varies depending on the material for the toner.

Moreover, when appropriately selected electrically conductive rubber is used in the frictional charging body, excessive frictional charging of the toner can be prevented. Accordingly, electrostatic coagulation or solidification of the toner can be prevented, and also, the toner which has been coagulated and solidified as such can be effectively loosened. In particular, when the toner is held electrostatically by the use of the magnetic sleeve as in the above-described concrete example, this effect of the frictional charging will be further remarkable, if consideration is so given as to increasing the holding effect of the toner to the surface of the toner carrying member. Incidentally, the magnetic toner used to obtain favorable result is a mixture consisting of 50 parts by weight of polystyrene, 40 parts by weight of magnetite, 3 parts by weight of electric charge control agent, and 6 parts by weight of carbon, and having an average particle size distribution of from 5 to 10 microns. In practicing the method of the present invention, not only the abovementioned device, but also various other modes can of course be adopted.

In the following, modified embodiments of the device according to the present invention will be explained. In advance of explaining these various embodiments, one example of the image forming device, to which the development device according to the present invention is applicable will be described in reference to FIG. 7, although the invention is not limited to this image forming device alone.

Figure 7:
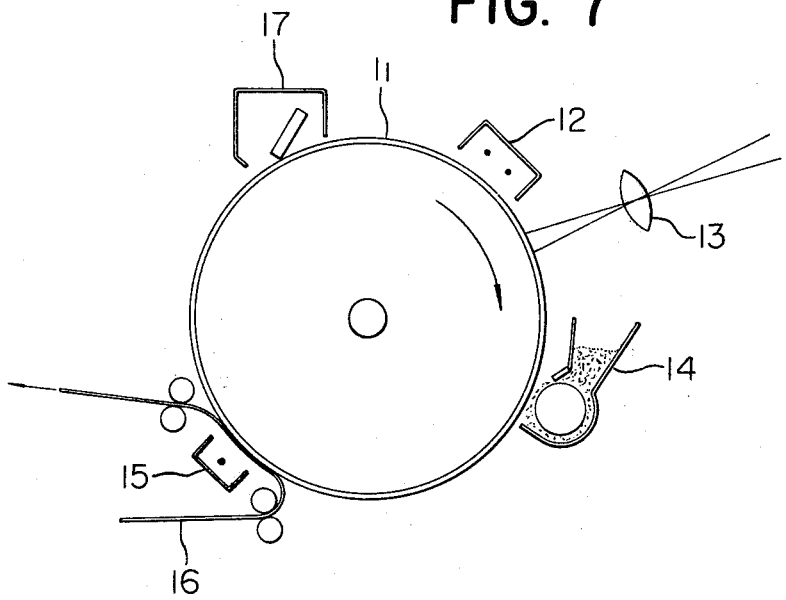
FIG. 7 is a schematic diagram of an actual reproduction apparatus, to which the developing device according to the present invention is applied.

In FIG. 7, a reference numeral 11 designates an electrostatic image holding member in a cylindrical form, which is a photosensitive body having a photoconductive layer supported therearound. A numeral 12 refers to a known photosensitizing and charging device, and 13 refers to a light image irradiating device which projects onto the photosensitive body a light beam, etc. modulated by an image original, or light image, or an image signal. The electrostatic image is formed on the photosensitive body through these components. Various kinds of electrostatic image forming processes can be utilized. That is, besides the Carlson process as illustrated, there may be utilized such processes as described in Japanese patent publication Nos. 42-23910, 43-24748, 42-19748, 44-13437, and so on. A reference numeral 14 designates a development device according to the present invention, by which a toner particle visible image in accordance with the electrostatic latent image on the photosensitive body 11 is formed. A numeral 15 refers to a device for transferring the toner image to an image transfer material 16. To improve the image transferability, electric charge is applied in some cases to the visible image before the image transfer by means of a corona discharger, etc. It is also possible to adopt the so-called electrostatic image transfer system, in which the electrostatic image on the photosensitive member 11 is once transferred to a separate image carrying member, and thereafter this image is rendered visible by the development device 14. A reference numeral 17 designates a cleaning device to remove the residual toner on the photosensitive body 11 after the image transfer to prepare for the subsequent use of the photosensitive body.

Figure 8:
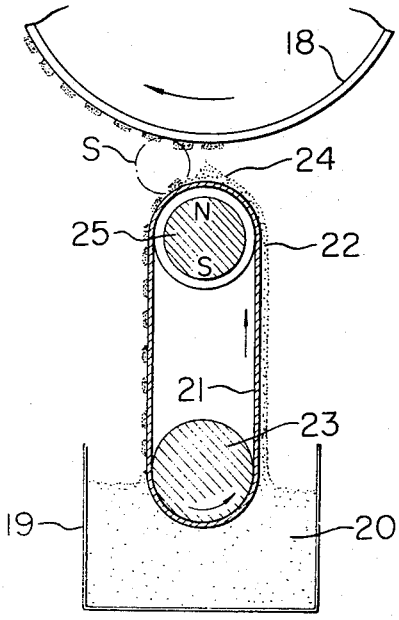
FIGS. 8 to 12 are explanatory diagrams of modified embodiments of the developing devices according to the present invention.

FIG. 8 shows one modified embodiment of the development device according to the present invention, in which a reference numeral 18 refers to the electrostatic latent image holding member which holds and transports the electrostatic image in the arrow direction, and 19 refers to a container for the magnetic toner, into which the magnetic toner 20 is filled through an appropriate hopper (not shown). The magnetic toner used for the development device according to the present invention may be any one of the electrically conductive toner and the insulative toner. In case the image transfer system to an image transfer material is adopted, use of the insulative toner is preferable from the standpoint of the image transferability.

The following explanations will be made with the insulative magnetic toner as the example. The magnetic toner 20 in the container 19 is frictionally charged through friction with a non-magnetic toner carrying member 21 in an endless belt shape and adhered onto the toner carrying member 21, and forms a toner layer 22. The toner layer 22 is then conveyed in the arrowed direction by rotation of a conveying roller 23, on which the endless belt shaped toner carrying member 21 is extended. The toner layer 22 which has been conveyed to the developing section 24 is napped by magnetic force of a magnet 25 fixedly positioned on the opposite side of the toner carrying member 21, i.e., at a position backside of the toner carrying member 21, and is served for development of the electrostatic image. At the time of the development, this toner layer moves in the same direction as the toner carrying member and the outermost layer part thereof is at the same speed as the electrostatic image surface. In order to regulate thickness of the toner layer in its napped state, and to avoid contact of the outermost layer of this napped toner layer to the non-image portion of the abovementioned electrostatic image, there is provided a thickness regulating plate and the like to maintain the tone layer at a predetermined thickness in accordance with the gap between the toner carrying member and the electrostatic image surface. In this manner, the napped toner is kept on the surface of the electrostatic image holding member with the abovementioned small gap, grows uniformly from the toner carrying member by the electric field of the electrostatic image in the presence of the magnetic field, and transfers to the surface of the electrostatic image for development. In order to maintain this small gap, there is disposed a freely rotatable roller, as a spacer S, at one end or both between the magnet 25 and the electrostatic image holding member, as shown by a chain line. For the material of the toner carrying member, such material as imparting to the toner the frictional charge of the opposite polarity to that of the electrostatic charge to be developed is selected, whereby application of the charge to the toner can be easily done.

Preferred compositions and materials for the magnetic toner, the toner carrying member, the toner layer thickness regulating plate, etc. as well as the surface magnetic flux density of the magnet, and so on are as already mentioned in the foregoing and also as will be mentioned in the preferred examples to appear later.

Figure 9:
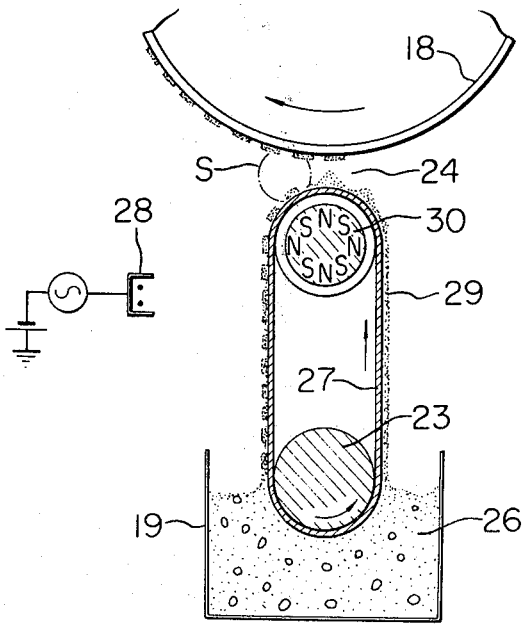

FIG. 9 shows a second modification of the developing device according to the present invention, in which the same elements as those in FIG. 8 are designated by the same reference numerals. A developing agent 26 consisting of a mixture of magnetic toner and iron powder carrier is accommodated in the toner container 19. A triboelectric charge is imparted to the insulative toner by means of a vibrating device (not shown), or by agitating the toner and the carrier through friction between the toner and the toner carrying member 27. While adhesion of the toner onto the toner carrying member 27 may be done by the frictional charging alone, more preferable results will be obtained if it is pre-charged with a corona discharger 28. The illustrated corona discharger 28 is so constructed that an a.c. voltage with its output voltage waveform being biassed may be applied. A reference numeral 30 refers to a multipolar magnet provided at the backside of the toner carrying member, and to cause the magnetic field to act on the toner. The magnet 30 has magnetic poles which causes the magnetic force to act on the magnetic toner 29 conveyed by the toner carrying member to thereby impart revolution to the toner on the toner carrying member, and to maintain uniform thickness of the toner layer. It is, of course, possible that a plate member to regulate the thickness of the toner layer be provided on the toner carrying member at the developing section. A numeral 24 refers to the development section where a small gap is provided between the surface of the toner layer 29 and the surface of the abovementioned electrostatic image holding member 18 to such an extent that the outermost layer of the toner does not contact the non-image portion of the electrostatic image holding member surface. The toner carrying member is so set that the outermost layer of the toner may move at the same speed and in the same direction as the abovementioned electrostatic image surface. At the development operation, the toner layer is napped in the presence of the magnetic field from the magnet 30, and this napped toner is further subjected to growth by the electric field of this electrostatic image, and uniformly leaves the toner carrying surface and transfers onto the electrostatic image surface for the development.

With such construction of the development device, the binary component developer within the toner container 19 is separated at the time of development so that the magnetic toner alone may take part in the development as the single component type developer. The characteristic of this construction of the development device resides in that the magnetic force is caused to act on the conveying path of the toner by the multipoles of the magnet 30 and at the development section, the toner moves revolving on the toner carrying member, thereby removing the non-uniformity in the toner thickness. The other characteristics are that the toner carrying member is charged by the use of the biassed a.c. corona discharge to cause the toner to adhere onto the toner carrying member, and, that, since the charge of the same polarity as that of the electrostatic image to be developed is biassed to be discharged in great deal, there is no possibility of the toner carrying member to be charged up. Further, in order to obtain the toner layer of uniform thickness, the toner is imparted to the toner carrying member with a binary component type developer. In this case, glass beads, or the like is used as the carrier, besides the iron powder, and a frictional charge in the opposite polarity as that of the electrostatic image is imparted to the toner.

Figure 10:
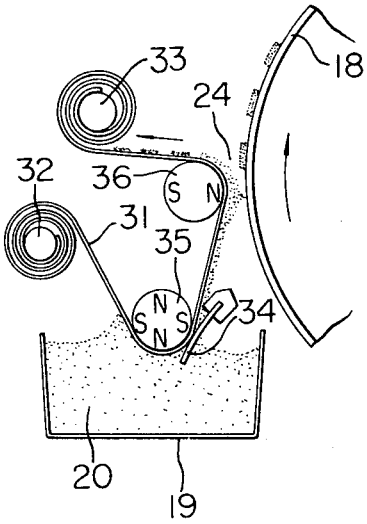

FIG. 10 is a third modification of the development device according to the present invention, in which the same component parts as those in FIGS. 8 and 9 are designated by the same reference numerals. In the drawing, a reference numeral 31 designates a belt-shaped toner carrying member which is extended between the forwarding roller 32 and the wind-up roller 33 to move in the arrow direction to transfer the toner to the electrostatic image from the lateral side of the drum-shaped electrostatic image holding member 18. A numeral 34 refers to a resilient blade to apply the magnetic toner 20 to the toner carrying member 31. The surface of this resilient blade is press-contacted to the toner carrying member to cause the magnetic toner to pass between the toner carrying member and the blade. At this time, thickness of the toner layer adhered onto the toner carrying member is controlled, and electric charge in the opposite polarity to that of the electrostatic image is imparted to the toner. The resilient blade may, of course, be of any shape such as in roll, belt, or other appropriate shapes. Or, it may be electrically conductive. A numeral 35 refers to a magnet to attract the magnetic toner 20 onto the toner carrying member 31 and to convey the toner upto the resilient blade for toner application. A numeral 36 also refers to a magnet to cause the magnetic field action to be exerted at the development section 24. It is to be noted that the gap at this development section may be maintained by an appropriate means (not shown), as has been mentioned in the foregoing embodiments.

The characteristic point of this embodiment is that the magnetic toner is attracted to the toner carrying member by the magnetic force of the separately provided magnet 35, thickness of the toner layer on the toner carrying member is controlled by the resilient toner application member with simultaneous charging of the same, and the toner carrying member in belt shape is wound up to remove undesirable effects of the resin and charge controlling agent, etc. in the toner as adhered onto the toner carrying member.

Figure 11:
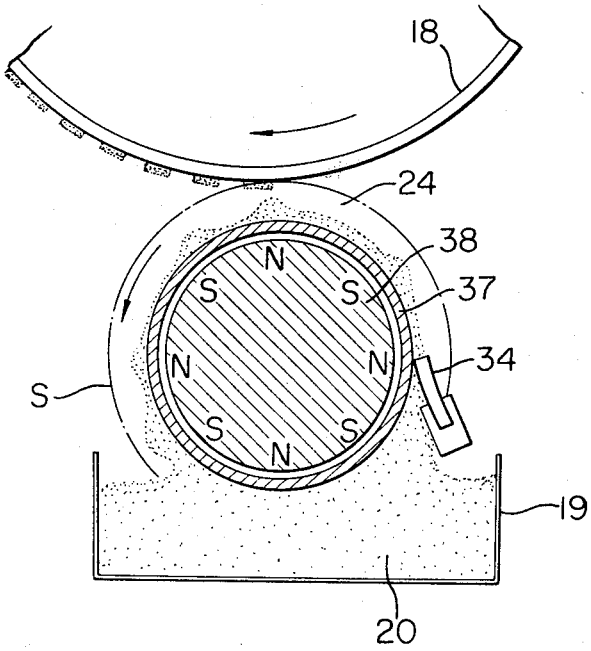

FIG. 11 shows the fourth modification of the development device according to the present invention, in which the same component parts as those in the foregoing embodiments are designated by the same reference numerals. In the drawing, a reference numeral 37 designates a cylinder made of a nonmagnetic material to be used as the magnetic toner carrying member. This cylindrical member is rotated in the arrow direction so that it may move in the same direction as that of the electrostatic image holding member and at the same speed at the outermost layer of the toner at the development section. The position of this cylindrical member may be arbitarily selected such as below or alongside the drum-shaped electrostatic image holding member. The gap between the surface of this non-magnetic cylindrical member and the surface of the electrostatic image holding member may be maintained constant by providing roller spacers S (shown by a chain line) at the end parts of the cylindrical member coaxially rotating therewith. A reference numeral 38 designates a magnet roll set in the non-magnetic cylindrical member 37. The magnet roll 38 has a plurality of magnetic poles. It is desirable that the magnet roll has, at least, a magnetic pole to pump up the magnetic toner 20 from the container 19 and a magnetic pole for the development to cause the magnetic field to act at the time of the development at the developing position. Further, it is desirable that a toner conveying magnetic pole is provided therebetween to secure uniform thickness in the toner layer. A numeral 34 refers to a layer thickness adjusting member which regulates the layer thickness of the magnetic toner 30 adhered onto the toner carrying member 37 and thinly applies the same on the toner carrying member surface 37. It is made of a resilient blade. This layer thickness adjusting member is contacted to the toner carrying member at a pressure of 0.4 to 40 gr./cm$^2$, as mentioned above, and the toner is caused to pass through this thickness adjusting member and the toner carrying member 37 to form the toner layer having the thickness to satisfy the abovementioned condition. The magnetic toner 20 to be fed from the toner hopper 19 may be either insulative or electrically conductive, as already mentioned. In the case of using the magnetic toner, the toner material and the material for the toner carrying member may preferably be selected as will be described hereinbelow so that the toner attracted onto the toner carrying member may have the frictional charge when moving on the toner carrying member. This electric charge is considered to be the factor of the toner transfer by being attracted by the electric field of the latent image at the development section.

In the case of using the electrically conductive toner, the mechanism of development is different from that in the case of using the insulative toner. That is, the magnetic toner carried on the toner carrying member by the magnetic force separates from the toner carrying member and transfers to the latent image due to injection of the electric charge in the opposite polarity to that of the latent image when the toner comes close to the latent image surface. Accordingly, it is desirable that the toner carrying member should be electrically conductive to enable the charge injection to be effected to the toner. When an insulative coating is applied to the surface of the toner carrying member from the standpoint of uniformity and durability thereof, grounding becomes necessary through the magnetic or electrically conductive toner layer, for which purpose the coating blade, etc. should preferably be made electrically conductive.

Figure 12:
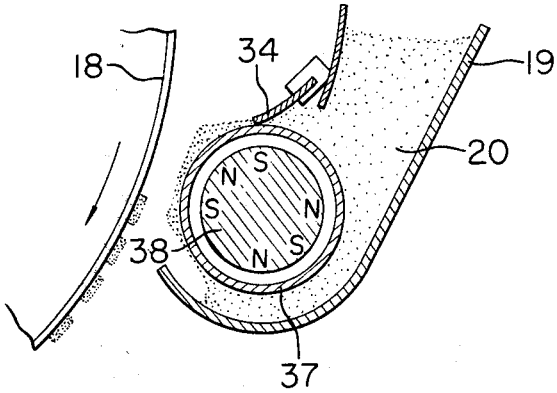

FIG. 12 shows the fifth modification of the development device according to the present invention, in which the same component elements as those in the previous embodiments are designated by the same reference numerals. The construction of this development device is the same as that shown in FIG. 11 with the exception that the magnetic toner layer is controlled by the magnetic field between the adjacent poles at the development section so as to effect the development, and that the construction of the development section is such that the developing operation from the lateral direction of the electrostatic latent image holding member 8 may be facilitated. In this development device, since the toner is held between the adjacent magnetic poles at the development section, the toner particles on the toner carrying member is in a state of being laid down on this carrying member as already mentioned in the foregoing with the consequence that mutual contact among the toner particles is large, and the confinement of the toner particles by the magnetic force is strong, whereby the space gap between the electrostatic image surface and the toner carrying member surface can be made very narrow, hence reproducibility of the thin letters is particularly improved. However, since the magnetic line of force does not extend in the direction of the electric line of force between the magnetic poles, eminent napping of the toner does not take place by the action of the magnetic field, and the image produced lacks uniformity. Accordingly, it is necessary to select either type of the development device depending on the nature of the image to be obtained, i.e., a type as shown in FIG. 11 wherein the magnetic poles are positioned at the development section, or a type as shown in FIG. 12 wherein the erection of toner ears occurs between the magnetic poles at the development section.

The abovementioned various embodiments of the development device according to the present invention make it possible to reduce their size to be adapted to any scale of the recording apparatuses. Also, these embodiments are so constructed that a uniform thin layer of toner may be formed on the toner carrying member, and that no toner may contact the non-image portion on the surface of the electrostatic image holding member but it is fed to the image portion thereof without failure, whereby the developed image of uniform density and free from fog can be obtained. In particular, the development is possible with a single component developer which requires no carrier substance, which enables the image quality to be uniform, and also increases its stability against any environmental changes. Further, when the magnetic force is utilized for the development, stability in the toner growth at the development operation can be augmented, and this contributes to improvement in the image quality. Furthermore, if this magnetic force is used for the toner conveyance, highly stable conveying capability to withstand fluctuations in relative humidity, and other factors can be obtained with a simplified construction. Even in the case of using the electrically conductive toner, the magnetic force makes it possible to realize stable toner conveyance, which is favorable in expanding the utility of the developing agent. Moreover, at the time of the toner conveyance, if the magnetic poles are disposed in such a manner that they may relatively move with the toner layer, such relative movement causes revolution of the toner, thereby promoting the uniform distribution of the toner layer. For example, the magnet roll 38 shown in FIG. 11 alternately or ranges different magnetic poles and is rotated. In this construction, it has been discovered as the result of experiments that not only the uniform toner layer can be obtained, but also the moving quantity of the magnetic toner on the toner carrying member can be controlled, hence it is advantageous in the sense of controlling the charge quantity, as well as in ameliorating tonality of the developed image. Further, in view of the moving magnetic field, the contacts among the toner particles are the least among those types of toner particles supported by the magnetic force, and, moreover, since the movement of the toner particles is vigorous, the binding force thereof is the least. Accordingly, the developed image is highly uniform, and the density of the black image is high. When the toner movement between too vigorous, the toner particles tend to scatter to the non-image region, hence care should be taken not to cause such scattering.

In order to facilitate understanding of the present invention, the following actual examples are presented.

EXAMPLE 1

On a CdS-bider type photosensitive body produced by coating an insulating layer (MYLAR—a trademark for a polyester film of E. I. du Pont de Nemour & Co., U.S.A.) on the surface of a drum-shaped member, there was formed an electrostatic image holding surface having a dark surface potential of 500 v and a bright surface potential of 0 v.

On the other hand, a toner of the following composition and having an average particle size of 8 microns was prepared.

Polystyrene: 70 wt. parts
Carbon: 8 wt. parts
Charge Control Agent: 2 wt. parts

By the use of the development device of the construction shown in FIG. 11, the abovementioned toner was applied in a thickness of 40 microns on an aluminum roll having a diameter of 30 mm used as the toner carrying member by regulating force of the aforementioned rubber blade. The toner thus applied was retained on the roller due to its electrostatic charge.

When the photosensitive body, on which the electrostatic image has been formed, and the aluminum roller surface were separated with a gap therebetween of 150 microns, i.e., the gap between the non-image portion of the photosensitive body and the surface of the aluminum roller was maintained at substantially 110 microns, and both photosensitive drum and aluminum roller were rotated in the same direction at a speed of 100 mm/sec. for the development, there could be obtained reproduction of a sharp image having no fog at the non-image region.

EXAMPLE 2

The electrostatic latent image was formed on the photosensitive body under the same conditions as in Example 1 above. The experiment was also conducted in the same manner as above, by utilizing the development device.

The toner of the following composition having an average particle size of 8 microns was prepared.

Polyester: 70 wt. parts
Magnetite: 20 wt. parts
Carbon: 8 wt. parts
Charge Control Agent: 2 wt. parts The abovementioned toner was applied onto a roll of 30 mm in diameter and provided inside thereof with a permanent magnet of 11,000 gausses on its surface. The magnetic field intensity of this permanent magnet on the surface of the aluminum roll was 800 gausses. When the magnetic poles of this magnet was positioned in confrontation to the photosensitive body to form a magnetic brush layer, the thickness of the magnetic brush was maintained at 60 microns, the gap between the photosensitive body and the aluminum roll was made 200 microns, i.e., the non-image region and the surface of the aluminum roller surface were maintained at approximately 140 microns, and both photosensitive drum and aluminum roll were rotated in the same direction at a speed of 100 mm/sec., there could be reproduced an image free from fading at its edge with the non-image region free from fog.

What we claim is:

1. A development method for developing an electrostatic image held on an electrostatic image holding member which can be used repeatedly for electrostatic latent image formation, said method comprising the steps of:

forming a layer of magnetic toner particles on a surface of a toner carrying member, said toner carrying member being made of a non-magnetic material and having a stationary magnetic pole at a developing zone on the opposite side of said toner particle layer forming surface thereof to establish a stationary magnetic field directed toward the surface of the electrostatic image holding member;

bringing said toner carrying member provided with the magnetic toner particle layer on the surface thereof adjacent to the electrostatic image holding member provided with an electrostatic image on its surface; and maintaining said toner carrying member and the electrostatic image holding member in a spacing range at the developing zone to form a space gap between the electrostatic image holding member and the surface of the layer of toner particles where the stationary magnetic field at the developing zone is effective to orient the magnetic toner particles in the direction of the magnetic field to assist in the deposition of toner particles on the image region of the electrostatic image holding member due to the attraction of the electrostatic field generating therefrom, the stationary magnetic field alone being insufficient to transfer the magnetic toner particles to the non-image background region of the electrostatic image holding member which has no substantial electrostatic field such that in the absence of an electrostatic image on the image holding member, no toner particles contact the image holding member.

2. The development method as claimed in claim 1, wherein the space gap between the surface of the toner particle layer on said toner carrying member and the surface of the electrostatic image holding member is maintained 10 times or below as large as the thickness of the toner particle layer.

3. The development method as claimed in claim 2 or 1, wherein the space gap between the surface of the toner particle layer on said toner carrying member and the surface of the electrostatic image holding member is maintained 1/5 or above of the thickness of the toner particle layer.

4. The development method as claimed in claim 3, wherein the thickness of the toner particle layer formed on said toner carrying member is 30 microns and above.

5. The development method as claimed in claim 1, wherein, at the time of forming the toner particle layer on said toner carrying member, the thickness of the toner particle layer to be applied to said toner carrying member is regulated by a layer thickness regulating member to obtain a toner particle layer of uniform thickness.

6. The development method as claimed in claim 1, wherein said toner carrying member is provided with an electrically conductive electrode, and the development is effected in a relationship of $D<5c$, where D represents the space gap between said electrically conductive electrode and the electrostatic image holding member, and c denotes the minimum image width of the electrostatic image formed on the electrostatic image holding member.

7. The development method as claimed in claim 6, wherein the development is effected in such a relationship that the space gap D between said electrically conductive electrode and the electrostatic image holding member is greater than the space gap between the surface of said toner particle layer and the surface of the electrostatic image holding member.

8. A development device for developing an electrostatic image held on an electrostatic image holding member which can be used repeatedly for electrostatic latent image formation, said device comprising in combination:

toner carrying means having a surface to hold a toner particle layer thereon, said toner carrying means being made of a non-magnetic material;

magnet means for generating a stationary magnetic field at a developing zone through said non-magnetic toner carrying means toward the surface of the electrostatic image holding member;

means for forming a layer of magnetic toner particles of substantially uniform thickness on said surface of said toner carrying means;

means for moving the magnetic toner layer from said toner layer forming means to a developing zone; and means for maintaining a space between said toner carrying means and the electrostatic image holding member at the developing zone within a predetermined range to form a space gap between the electrostatic image holding member and the surface of the layer of toner particles, wherein the stationary magnetic field at the developing zone is directed toward the electrostatic image holding member to thereby assist in depositing toner particles on the image region of the electrostatic image holding member due to the attraction of the electrostatic field generating therefrom, the stationary magnetic field being insufficient to transfer the magnetic toner particles to the non-image background region of the electrostatic image holding member such that in the absence of an electrostatic image no toner particles contact with the image holding member, whereby background development is prevented.

9. The development device as claimed in claim 8, wherein the toner carrying surface of said toner carrying means is formed in a movable and endless shape.

10. The development device as claimed in claim 8, wherein said toner carrying means is provided with a toner particle layer thickness regulating member to regulate the toner particle layer to be formed on the toner carrying surface to a predetermined thickness.

11. The development device as claimed in claim 9, wherein said toner carrying means is provided with a corona discharge generating source to apply corona discharge on the toner carrying surface thereof prior to formation of the toner particle layer on the toner carrying surface thereof.

12. The development device as claimed in claim 10, wherein said toner particle layer thickness regulating member is made of a material which imparts a predetermined charge characteristic to the toner particles.

13. The development device as claimed in claim 8, wherein said gap maintaining means maintains the space gap between the surface of the toner particle layer on said toner carrying surface and the surface of the electrostatic image holding member at a value 10 times or below as large as the thickness of the toner particle layer.

14. The development device as claimed in claim 13 or 8, wherein said space gap maintaining means maintains the space gap between the surface of the toner particle layer on said toner carrying surface and the surface of the electrostatic image holding member at a value 1/5 and above of the thickness of the toner particle layer.

15. The development device as claimed in claim 8, wherein said space gap maintaining means is provided with a space roller inserted between the surface of the electrostatic image holding member and the toner carrying surface of said toner carrying means.

16. A method according to claim 1, wherein said toner carrying member is electrically conductive.

17. A developing device according to claim 8, wherein said toner carrying member is electrically conductive.

18. The development device as claimed in claim 14, wherein the thickness of the toner particle layer formed on said toner carrying means is 30 microns or more.

19. A development method according to claim 1, wherein said toner particles are electrically insulative.

20. A development device according to claim 8, wherein said toner particles are electrically insulative.

* * * * *

UNITED STATES PATENT AND TRADEMARK OFFICE

CERTIFICATE OF CORRECTION

PATENT NO. : 4,356,245

DATED : October 26, 1982

INVENTOR(S) : NAGAO HOSONO, ET AL.

It is certified that error appears in the above-identified patent and that said Letters Patent is hereby corrected as shown below:

Column 1, line 14, "image" should read --images--;
line 15, "images" should read --image--.

Column 8, line 9, "b" should read --d--.

Column 9, line 2, "the present invention" should read --of the present invention--.

Column 16, line 49, "bider" should read --binder--.

Signed and Sealed this

Twelfth Day of April 1983

[SEAL]

Attest:

GERALD J. MOSSINGHOFF

Attesting Officer

Commissioner of Patents and Trademarks